US006531038B2

(12) United States Patent
Knies et al.

(10) Patent No.: US 6,531,038 B2
(45) Date of Patent: Mar. 11, 2003

(54) CATHODE ARRANGEMENT

(75) Inventors: Gunter Knies, Osnabrück (DE); Reinhardt Ax, Wallenhorst (DE)

(73) Assignee: KM Europa Metal AG, Osnabruck (DE)

( * ) Notice: Subject to any disclaimer, the term of this patent is extended or adjusted under 35 U.S.C. 154(b) by 99 days.

(21) Appl. No.: 09/768,789

(22) Filed: Jan. 24, 2001

(65) Prior Publication Data

US 2001/0025785 A1 Oct. 4, 2001

(30) Foreign Application Priority Data

Jan. 25, 2000 (DE) ..... 100 03 012

(51) Int. Cl.[7] ..... B23H 3/04

(52) U.S. Cl. ..... 204/286.1; 204/279; 204/281; 204/297.01; 204/287

(58) Field of Search ..... 204/279, 280, 204/281, 286.1, 287, 297.01

(56) References Cited

U.S. PATENT DOCUMENTS 5,492,609 A 2/1996 Assenmacher ..... 204/286

FOREIGN PATENT DOCUMENTS

| | | |
|---|---|---|
| EP | 0 175 395 | 3/1986 |
| EP | 0 301 115 | 2/1989 |

*Primary Examiner*—Bruce F. Bell
(74) *Attorney, Agent, or Firm*—Kenyon & Kenyon

(57) ABSTRACT

A cathode arrangement having a mounting rail (1) and a cathode plate (2) bonded to the mounting rail (1). Two parallel, flanges extending in its longitudinal direction are formed on the underside (5) of the mounting rail (1). The cathode plate (2) is accommodated and bonded to the flanges (8, 9) by explosion welding between the parallel flanges. A full-surface metal-to-metal bond is thus obtained, which has very good current-conducting properties at the contact surfaces between the flanges (8, 9) and the cathode plate (2). The ends of the mounting rail (1) projecting over the cathode plate (2) have a flangeless design and have oblique surfaces (6, 7) intersecting in the shape of a wedge on the underside.

11 Claims, 2 Drawing Sheets

CATHODE ARRANGEMENT

FIELD OF THE INVENTION

The present invention relates to a cathode arrangement for an electrolytic bath for electrolytic production of pure metals, in particular copper.

BACKGROUND OF THE INVENTION

In refining raw metals using electrolysis to obtain pure metals, the metal is extracted from an impure anode in an electrolytic bath and deposited onto a cathode in pure form. The impurities remain dissolved in the electrolyte or form the anode sludge.

Different designs are known for the cathodes used in electrolysis. The designs differ mainly in the selection of materials or material combinations of the mounting rail and cathode plate with a view to good electric conductivity, mechanical stability, corrosion resistance, and in order to minimize energy loss. For refining copper, arrangements are known in which the mounting rail is made of a steel-jacketed non-ferrous metal core or has a steel core which is electrolytically copper plated. In the known cathode arrangements, the cathode plate is connected to the current-conducting mounting rail by welding metals of the same type of the mounting rail and cathode plate, such as steel/steel, or by soldering in the case of different metals. Furthermore, U.S. Pat. No. 5,492,609 and European Patent Application 175 395 A1 describe a mounting rail made of copper welded to a cathode plate made of stainless steel.

European Patent Application 301 115 A1 describes a mounting rail having a steel core, which is provided with a thick electrolytic copper plating, the bonding surfaces for the steel cathode plate being subsequently explosion plated with a steel strip to which the steel cathode plate is subsequently welded.

The disadvantage of the known cathode arrangements is their high manufacturing cost. In particular, when steel-reinforced mounting rails are to be provided with thick electrolytic copper plating in order to avoid power losses due to voltage drops, manufacturing is extremely costly and time-consuming.

Welding together different metals such as copper and stainless steel also represents a technical problem. Furthermore, in industrial welding, the workpieces are subjected to considerable warming during the welding process, which may result in longitudinal stresses and deformation of the mounting rail and, in unfavorable cases, in buckling of the cathode plate. For this reason, only discontinuous or spot welds are used in practice, which, however, result in considerable voltage losses at the contact points and in reduced current efficiency.

SUMMARY OF THE INVENTION

The object of the present invention is to provide an improved cathode arrangement which achieves minimum power losses at the passage of current from the mounting rail to the cathode plate and which can be manufactured inexpensively.

According to the present invention, this object is achieved with a cathode arrangement in which the mounting rail has an essentially rectangular cross-section and has two parallel flanges extending in the longitudinal direction of the mounting rail on the underside. The cathode plate is accommodated between these two flanges and bonded to the flanges by cold pressure welding. The ends projecting over the cathode plate are designed without flanges at least in the areas reaching the system on the bus bars of the electrolytic bath and have oblique surfaces intersecting in the shape of a wedge at the bottom.

A drawn copper section is preferably used as a mounting rail. The mounting rail may also be designed as a hollow section. The cathode plate, also referred to in the industry as the mother plate, is made of corrosion-resistant stainless steel. In special cases, a cathode plate made of rolled copper may also be used.

The height of the mounting rail is preferably greater than its width. This measure results in a high section modulus. The resulting bending strength has a positive effect on the overall stability of the cathode arrangement, which is advantageous in particular when deposited metal layers are removed (stripped) mechanically.

The flanges designed in one piece on the underside of the mounting rail are used for accommodating and securing the cathode plate. The cathode plate is perpendicular to the mid-section plane of the mounting rail. The flanges are bonded to the cathode plate by cold pressure welding, which is preferably performed by explosion welding. For this purpose, the cathode plate is pressed into the opening between the two flanges, whose external surfaces are coated with an explosive. The explosive is ignited so that a detonation front is formed which propagates over the surface and presses the flanges against the cathode plate. Due to the very high surface pressure, the boundary layers fuse together in the collision zone, forming a firm, full-surface bond having very good current-conducting properties from the contact surfaces of the flanges to the cathode plate. The full-surface metal bond ensures uniform passage of current over the entire bonding surface of the mounting rail and the cathode plate. Voltage losses at the contact points are minimized and the current efficiency is increased. Due to the type of bond obtained by explosion welding, unacceptable longitudinal stresses due to thermal effects and resulting deformations of the cathode arrangement are also avoided.

No disadvantageous heat is introduced in the bonding zones. Thus no fusion processes from which bonding faults or slag or gas inclusions may result can occur. Consequently, points with increased resistance are eliminated.

The full-surface metallic bond between the mounting rail and the cathode plate also increases the mechanical strength of the cathode arrangement.

The length and height of the flanges-can be determined according to the respective application. The advantage is that, when a cathode plate made of corrosion-resistant stainless steel is used, the copper-free area between the electrolyte surface and the mounting rail can be optimized according to the application. Thus, disadvantageous power losses can be reduced in these areas.

In order to accommodate-the cathode arrangement on the bus bars installed parallel to the electrolytic bath, the mounting rails have a flangeless design and are provided with oblique surfaces intersecting in the shape of a wedge on the underside. Thus the mounting rails are placed on the bus bars located in the central longitudinal plane of the mounting rail, forming a linear contact. The advantage of this installation geometry is a secure and always vertical attachment of the cathode arrangement in the electrolytic bath. This contributes to problem-free electrolysis operation.

The lateral surfaces and the top surface of the mounting rail may have a shaped design. The shaped design contributes to improve heat removal over the mounting rail. Heat removal is facilitated through such an enlarged surface.

Furthermore, recesses may be provided on the mounting rails and/or on the cathode plate. The recesses may be used as lifting aids and facilitate handling of the cathode arrangement according to the present invention during manufacture and operation. Normally the recesses are arranged in the cathode plate below the mounting rail, so that the necessary lifting devices can be engaged there. The recesses are also used as passages for the electrolyte flow.

BRIEF DESCRIPTION OF THE DRAWINGS

The invention is described in detail below with reference to the embodiments illustrated in the drawings.

DETAILED DESCRIPTION OF THE INVENTION

A first embodiment of a cathode arrangement according to the present invention is described with reference to FIGS. 1 through 3.

The cathode arrangement includes a mounting rail 1 made of copper and a cathode plate 2 made of corrosion-resistant stainless steel, permanently bonded to mounting rail 1. The cathode plate 2 for refining raw copper is suspended from the mounting rail 1 into an electrolytic bath not illustrated here. The ends 3, 4 of the mounting rail 1 come into contact with bus bars running parallel to the electrolytic bath, establishing an electric contact.

Figure 2:
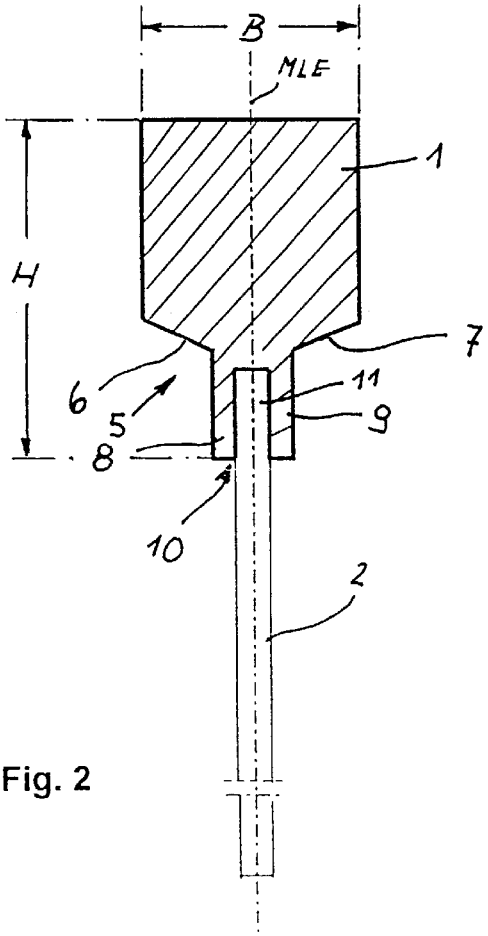
FIG. 2 shows a vertical cross-section through the cathode arrangement of FIG. 1 along line A-B.
Figure 3:
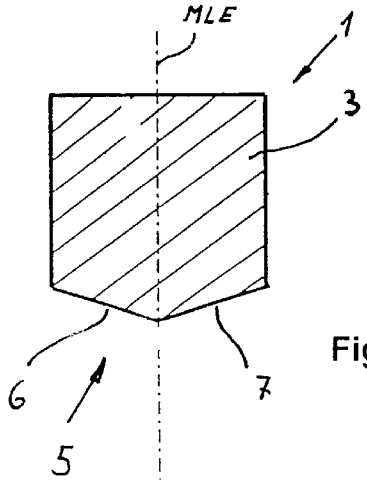
FIG. 3 shows a vertical cross-section through the mounting rail of the cathode arrangement according to FIG. 1 along line C-D.

As can be seen in FIGS. 2 and 3, mounting rail 1 has a substantially rectangular cross-section. Oblique surfaces 6, 7 on the underside 5 of the mounting rail 1 intersect in the shape of a wedge. Two flanges 8, 9 are pressed together on the underside 5 parallel to a central longitudinal plane MLE of the mounting rail 1.

The two flanges 8,9 extend over the length of the cathode plate 2 and form a seat 10 for the upper longitudinal side 11 of the cathode plate 2. The cathode plate 2 is bonded to the mounting rail 1 via the flanges 8, 9 by explosion welding. With this type of cold pressure bonding through surface pressing, the boundary layers between the flanges 8, 9 and the cathode plate 2 are fused with one another, which results in full-surface permanent bonding. The metal-to-metal surface bond is mechanically highly resistant and ensures optimum passage of current from the mounting rail 1 to the cathode plate 2 with reduced resistance at the boundary layer.

In order to accommodate the mounting rail 1 on the bus bars mounted parallel to the electrolytic bath, the flanges 8, 9 are mechanically removed at the ends 3, 4, extending oblique surfaces 6, 7. The oblique surfaces 6, 7 are, consequently, wedge-shaped at their ends, resulting in a mount having a linear contact with the bus bars in the central longitudinal plane MLE of the mounting rail 1. This geometry of placing the ends 3, 4 on the current-supplying bus bars ensures the vertical orientation of the cathode plate 2 which is important for successful electrolysis.

The height H of the mounting rail 1 is greater than its width B. The section modulus of the mounting rail 1 ensures high resistance to bending. This measure, together with the full-surface metallic bond of the flanges 8, 9 with the cathode plate 2 has a positive effect on the overall stability of the cathode arrangement. The shear strength and the adhesion strength correspond to the mechanical properties of the material of the flanges 8, 9.

Figure 1:
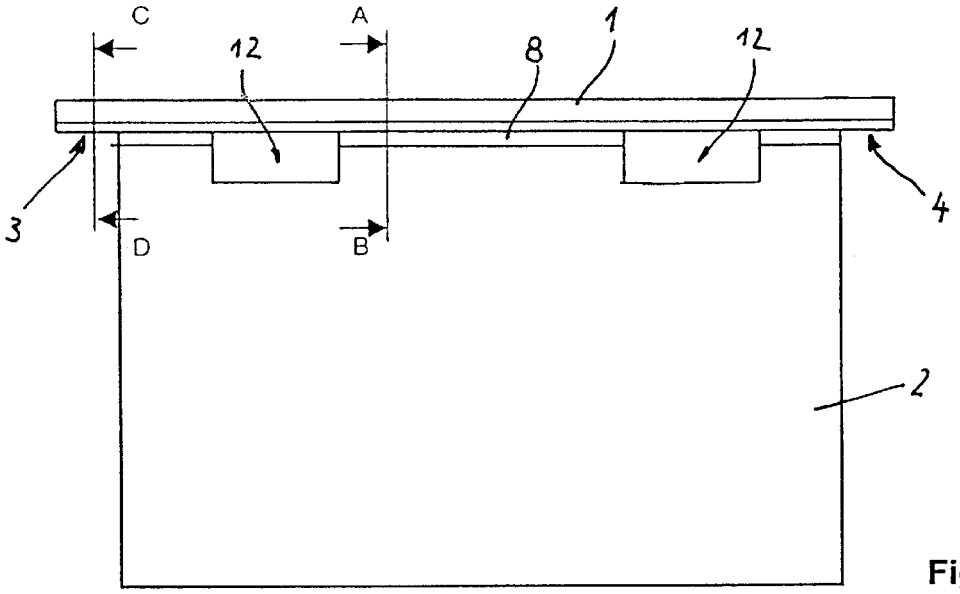
FIG. 1 schematically shows a cathode arrangement according to the present invention in side view.

In FIG. 1, the recesses 12 in the cathode plate 2 are under the mounting rail 1 and are used as lifting aids for handling the cathode arrangement.

Figure 4:
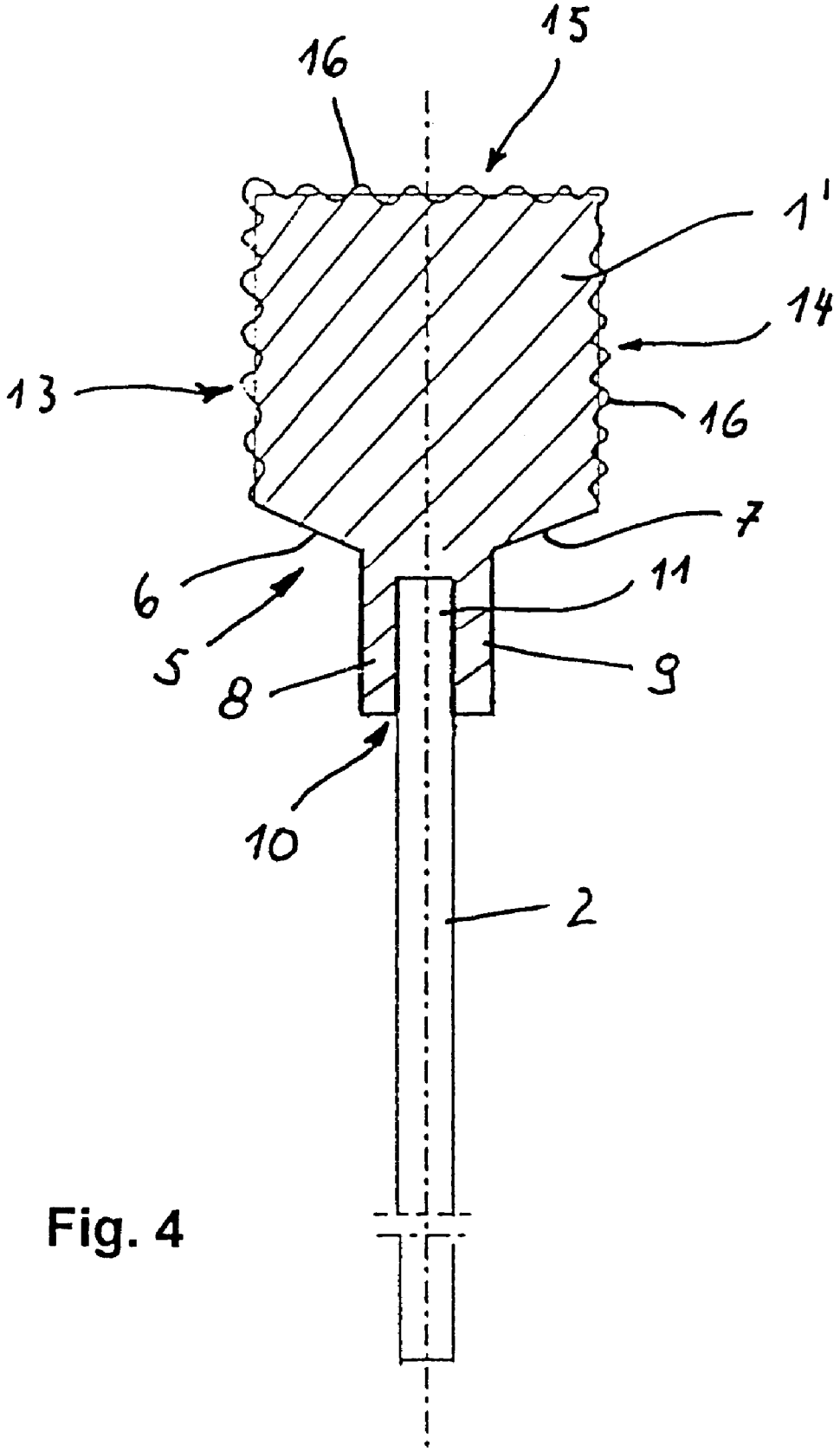
FIG. 4 shows a vertical cross-section through another embodiment of a cathode arrangement according to the present invention.

FIG. 4 shows an embodiment of basically the same type of cathode arrangement. Corresponding components are identified by the same symbols. The lateral surfaces and the top surface of the mounting rail 1' of this cathode arrangement are shaped by cooling ribs 16, which contribute to improve to heat removal over the mounting rail 1'.

What is claimed is:

1. A cathode arrangement for an electrolytic bath for electrolytic production of pure copper, comprising:

a current-supplying mounting rail, the mounting rail having a rectangular cross-section and having on its underside, which comprises oblique, non-rounded, grooveless surfaces tapered toward each other, two parallel flanges between the grooveless surfaces extending in the longitudinal direction of the mounting rail, the ends of the mounting rail contacting bus bars of the electrolytic bath;

a cathode plate bonded to the mounting rail between the parallel flanges, the plate being bonded to the flanges by explosion welding, to form a full-surface metal bond, wherein the ends of the mounting rail that projects over the cathode plate have a flangeless design and oblique, non-rounded surfaces intersecting in the shape of a wedge on the underside.

2. The cathode arrangement according to claim 1, wherein the height of the mounting rail is greater than its width.

3. The cathode arrangement according to claim 2, wherein the lateral surfaces and the top surface of the mounting rail are shaped to enhance heat removal.

4. The cathode arrangement according to claim 3, wherein the mounting rail is made of copper.

5. The cathode arrangement according to claim 1, wherein the lateral surfaces and the top surface of the mounting rail are shaped to enhance heat removal.

6. The cathode arrangement according to claim 5, wherein recesses are provided on the mounting rail and/or the cathode plate.

7. The cathode arrangement according to claim 6, wherein the mounting rail is made of copper.

8. The cathode arrangement according to claim 1, wherein recesses are provided on the mounting rail and/or the cathode plate.

9. The cathode arrangement according to claim 8, wherein the mounting rail is made of copper.

10. The cathode arrangement according to claim 1, wherein the mounting rail is made of copper.

11. A cathode arrangement for an electrolytic bath for electrolytic production of pure copper, comprising:

a current-supplying, hollow copper mounting rail, the mounting rail having a rectangular cross-section and having on its underside, which comprises oblique, non-rounded, grooveless surfaces tapered toward each other, two parallel flanges between the grooveless surfaces extending in the longitudinal direction of the mounting rail, the ends of the mounting rail contacting bus bars of the electrolytic bath;

a corrosion resistant stainless steel cathode plate bonded to the mounting rail between the parallel flanges, the plate being bonded to the flanges by explosion welding, to form a full-surface metal bond, wherein the ends of the mounting rail that projects over the cathode plate have a flangeless design and oblique, non-rounded surfaces intersecting in the shape of a wedge on the underside.

* * * * *